US011313066B2

(12) United States Patent
Huang et al.

(10) Patent No.: US 11,313,066 B2
(45) Date of Patent: Apr. 26, 2022

(54) CLOTHING TREATMENT AGENT DISPENSING ASSEMBLY FOR USE IN CLOTHING TREATMENT DEVICE, AND CLOTHING TREATMENT DEVICE

(71) Applicants: QINGDAO HAIER DRUM WASHING MACHINE CO., LTD., Qingdao (CN); Haier Smart Home Co., Ltd., Qingdao (CN)

(72) Inventors: Tao Huang, Qingdao (CN); Baozhen Cheng, Qingdao (CN); Huacheng Zhang, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 0 days.

(21) Appl. No.: 17/049,180

(22) PCT Filed: Apr. 11, 2019

(86) PCT No.: PCT/CN2019/082245
§ 371 (c)(1),
(2) Date: Oct. 20, 2020

(87) PCT Pub. No.: WO2019/201152
PCT Pub. Date: Oct. 24, 2019

(65) Prior Publication Data

US 2021/0238789 A1 Aug. 5, 2021

(30) Foreign Application Priority Data

Apr. 20, 2018 (CN) ..... 201810361881.8

(51) Int. Cl.
*D06F 39/02* (2006.01)

(52) U.S. Cl.
CPC ..... *D06F 39/02* (2013.01)

(58) Field of Classification Search
CPC ..... D06F 39/02
(Continued)

(56) References Cited

U.S. PATENT DOCUMENTS

2006/0162392 A1 7/2006 Kwon et al.
2016/0153133 A1* 6/2016 Del Pos ..... D06F 39/02 68/12.18

FOREIGN PATENT DOCUMENTS

CN 203878372 U * 10/2014
CN 104674511 A 6/2015
(Continued)

OTHER PUBLICATIONS

CN203878372U—machine translation (Year: 2014).*
International Search Report dated Jul. 10, 2019 in corresponding International application No. PCT/CN2019/082245; 4 pages.

*Primary Examiner* — Tinsae B Ayalew
(74) *Attorney, Agent, or Firm* — Maier & Maier, PLLC

(57) ABSTRACT

A clothing treatment agent dispensing assembly for use in a clothing treatment device, and a clothing treatment device, the clothing treatment device including a body, the clothing treatment agent dispensing assembly including a dispensing container and a storage container in sealed connection to one another, the vertical cross-section of the dispensing container being smaller than the vertical cross-section of the storage container, and the dispensing container and the storage container both being capable of sliding relative to the body, such that when the dispensing container is pulled out of the body, the storage container can follow the dispensing container to slide in the body. The present clothing treatment device is more flexible in the layout of the overall space, such that the layout and installation of components
(Continued)

such as a control panel are more flexible, facilitating product design.

7 Claims, 2 Drawing Sheets

(58) Field of Classification Search
USPC ..... 68/12.18
See application file for complete search history.

(56) References Cited

FOREIGN PATENT DOCUMENTS

| | | | |
|---|---|---|---|
| CN | 107254761 | A | 10/2017 |
| CN | 107354679 | A | 11/2017 |
| CN | 208266485 | U | 12/2018 |
| CN | 208266491 | U | 12/2018 |
| EP | 2 765 233 | A1 | 8/2014 |

* cited by examiner

CLOTHING TREATMENT AGENT DISPENSING ASSEMBLY FOR USE IN CLOTHING TREATMENT DEVICE, AND CLOTHING TREATMENT DEVICE

FIELD

The present disclosure belongs to the technical field of clothing treatment, and specifically provides a clothing treatment agent dispensing assembly for use in a clothing treatment device, and a clothing treatment device.

BACKGROUND

A clothing treatment device is a machine capable of washing, spin-drying, dry cleaning and/or drying clothing. Commonly seen clothing treatment devices include washing machines, shoe washers, clothing dryers, dry cleaning machines, and washer-dryer integrated machines. Taking a washing machine as an example, in order to ensure the washing effect of clothing, detergent/washing powder is often added into the water before the clothing is washed, so as to use surfactants to clean stains and/or oil stains on the clothing.

In the related art, a washing machine is usually provided with a detergent dispensing assembly, through which the detergent/washing powder can be injected into a washing cavity of the washing machine. The detergent dispensing assembly is typically of a drawer type, which includes a dispensing box and a storage box that are integrally formed. That is, the dispensing box and the storage box constitute a drawer. The disadvantage of this structure is that when the detergent needs to be added, the drawer is pulled out first as a whole, and then the detergent is poured, which makes it necessary to provide an opening that fits the entire drawer on a panel of the washing machine. Since the overall size of the drawer is larger, the opening on the panel is also larger, which makes the washing machine have limitations in the overall spatial arrangement. For example, in order to ensure the beauty and consistency of the washing machine, a control panel of the washing machine needs to be set at the same height as the above-mentioned opening so that the overall size of the control panel of the washing machine is also made larger, which not only increases the manufacturing cost, but also is not advantageous for the overall aesthetics of the washing machine.

Accordingly, there is a need in the art for a new clothing treatment agent dispensing assembly for use in a clothing treatment device as well as a corresponding clothing treatment device to solve the above problems.

SUMMARY

In order to solve the above-mentioned problems in the related art, that is, to solve the problem that the drawer of the clothing treatment agent dispensing assembly of the existing clothing treatment devices needs to be drawn out as a whole during the process of dispensing the clothing treatment agent and therefore the overall spatial arrangement of the clothing treatment device has limitations, the present disclosure provides a clothing treatment agent dispensing assembly for use in a clothing treatment device. The clothing treatment device includes a body, and the clothing treatment agent dispensing assembly includes a dispensing container and a storage container that are sealingly connected to each other; a vertical section of the dispensing container is smaller than a vertical section of the storage container, and both the dispensing container and the storage container are capable of sliding relative to the body, so that the storage container can slide with the dispensing container in the body when the dispensing container is being pulled out of the body.

In a preferred technical solution of the above clothing treatment agent dispensing assembly, the clothing treatment agent dispensing assembly further includes a dispensing mechanism fixedly connected to or integrally formed with the body, and the dispensing container and the storage container are slidingly connected with the dispensing mechanism.

In a preferred technical solution of the above clothing treatment agent dispensing assembly, the dispensing mechanism includes a containing cavity, the storage container is at least partially embedded in the containing cavity, and a length of the storage container is less than a length of the containing cavity.

In a preferred technical solution of the above clothing treatment agent dispensing assembly, a depth of the dispensing container is smaller than a depth of the storage container, and/or a width of the dispensing container is smaller than a width of the storage container.

In a preferred technical solution of the above clothing treatment agent dispensing assembly, the dispensing container is provided with a first sliding portion, the storage container is provided with a second sliding portion, and the dispensing mechanism is provided with a plurality of rollers matching the first sliding portion and the second sliding portion; the dispensing container is slidingly connected with the dispensing mechanism through the first sliding portion and the plurality of rollers, and the storage container is slidingly connected with the dispensing mechanism through the second sliding portion and the plurality of rollers.

In a preferred technical solution of the above clothing treatment agent dispensing assembly, the first sliding portion and the second sliding portion are disposed collinearly.

In a preferred technical solution of the above clothing treatment agent dispensing assembly, the dispensing container is provided with a first dispensing cavity and a second dispensing cavity, both of which are in communication with the storage container.

In a preferred technical solution of the above clothing treatment agent dispensing assembly, the first dispensing cavity is in communication with the storage container through a first communication channel, the second dispensing cavity is in communication with the storage container through a second communication channel, and both the first communication channel and the second communication channel are disposed inclined downwardly in a direction toward the storage container along the dispensing container.

In a preferred technical solution of the above clothing treatment agent dispensing assembly, the clothing treatment device further includes a trim panel which is connected to the dispensing container, and when the clothing treatment agent dispensing assembly is completely accommodated in the body, the trim panel is flush with an outer surface of the clothing treatment device.

In another aspect, the present disclosure also provides a clothing treatment device, which includes the clothing treatment agent dispensing assembly described above.

In the preferred technical solution of the present disclosure, the vertical section of the dispensing container is set to be smaller than the vertical section of the storage container, and the dispensing container can be drawn out of the body, whereas the storage container can only slide inside the body; those skilled in the art can understand that with this arrangement, only one opening adapted to the dispensing container needs to be provided on a shell or panel of the clothing treatment device, without considering the size of the storage container. In contrast, the size of the dispensing container can be much smaller than that of the storage container, so that the size of the opening located on the shell/panel and adapted to the dispensing container is smaller, thus saving the arrangement space on the shell/panel and making the overall arrangement of the clothing treatment device more flexible. Specifically, in practical applications, the depth of the dispensing container can be set to be small, so that the height of the control panel is also small, which can reduce the manufacturing cost of the clothing treatment device while meeting the requirements, and is also advantageous for the overall aesthetics of the clothing treatment device; alternatively, the width of the dispensing container is set to be small, so as to reserve more placement space for the control panel and provide more options for the placement position of the control panel, so that the overall arrangement of the clothing treatment device can be more flexible.

Further, by setting the dispensing container and the storage container to be in rolling-friction fit with the dispensing mechanism, a drawing operation on the drawer (i.e., the dispensing container and the storage container) is made more convenient as compared with the sliding-friction fit in the related art, and the wear between the dispensing container, the storage container and the dispensing mechanism can be reduced as much as possible, thereby improving the service life of the clothing treatment agent dispensing assembly.

Furthermore, the inclined arrangement of the first communication channel and the second communication channel is more advantageous for the flow of the clothing treatment agent; that is, the clothing treatment agent can flow from the dispensing container to the storage container more easily, thereby making the dispensing operation more convenient and improving the efficiency of the dispensing operation.

Still further, the trim panel is set to be flush with the outer surface of the clothing treatment device when the drawer is retracted into the body, which can make the surface of the entire clothing treatment device more flat, improve the appearance aesthetics of the clothing treatment device, and prevent the user from rubbing against the trim panel when using the clothing treatment device to deform the trim panel, which would otherwise affect the normal use of the device.

In addition, due to the use of the above described clothing treatment agent dispensing assembly, the clothing treatment device further provided by the present disclosure on the basis of the above technical solution has the technical effects of the above clothing treatment agent dispensing assembly; moreover, as compared with the clothing treatment device before the improvement, the clothing treatment device of the present disclosure is more flexible in the overall spatial arrangement, especially the arrangement on the outer surface of the shell/panel, which makes the arrangement and installation of components such as the control panel more flexible and facilitates technicians in designing the product.

BRIEF DESCRIPTION OF THE DRAWINGS

Hereinafter, preferred embodiments of the present disclosure will be described with reference to the accompanying drawings and in conjunction with a washing machine. In the drawings.

DETAILED DESCRIPTION

Figure 1:
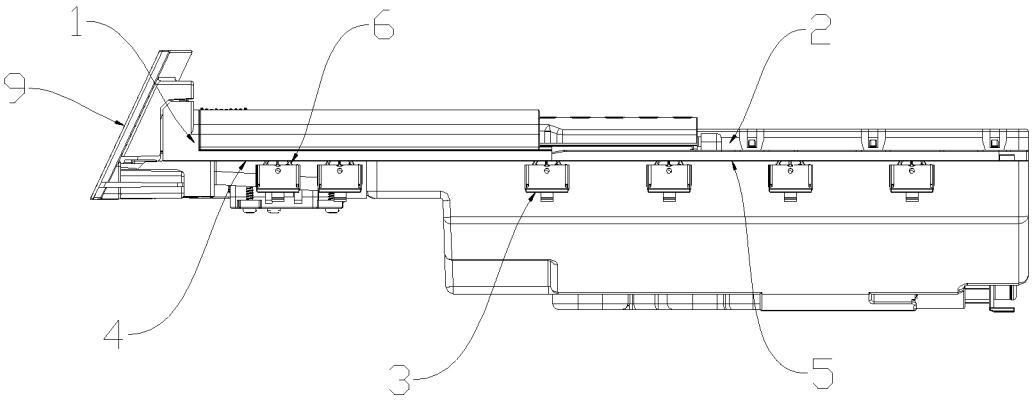
FIG. 1 is a first schematic structural view of a detergent dispensing assembly for use in a washing machine according to the present disclosure.

First, it should be understood by those skilled in the art that these embodiments are only used to explain the technical principles of the present disclosure, and are not intended to limit the scope of protection of the present disclosure. For example, although the following embodiments are explained in conjunction with a washing machine, this is not limitative. The technical solutions of the present disclosure are also applicable to other clothing treatment devices, such as air washing devices, shoe washers and washer-dryer integrated machines. Such a change to application object does not deviate from the principle and scope of the present disclosure.

It should be noted that in the description of the present disclosure, directional or positional relationships indicated by terms such as "center", "upper", "lower", "vertical", "horizontal", "inner" and "outer" are based on the directional or positional relationships shown in the drawings. They are merely used for the convenience of description, and do not indicate or imply that the device or element involved must have a specific orientation, or be configured or operated in a specific orientation, and therefore they should not be construed as limiting the present disclosure. In addition, terms "first" and "second" are used for descriptive purpose only, and should not be construed as indicating or implying relative importance.

In addition, it should also be noted that in the description of the present disclosure, unless otherwise clearly specified and defined, terms "dispose", "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem pointed out in the "BACKGROUND OF THE INVENTION" that the drawer of the detergent dispensing assembly of the existing washing machines needs to be drawn out as a whole during the process of dispensing the detergent and therefore the overall spatial arrangement of the washing machine has limitations, the present disclosure provides a detergent dispensing assembly for use in a washing machine, and a washing machine, aiming at making the washing machine more flexible in the overall spatial arrangement, especially the arrangement on the outer surface of the shell/panel, so as to make the arrangement and installation of components such as the control panel more flexible and facilitate technicians in designing the product.

Specifically, the washing machine of the present disclosure includes a body, and the detergent dispensing assembly includes a dispensing container and a storage container that are sealingly connected to each other. A vertical section of the dispensing container is smaller than a vertical section of the storage container. Both the dispensing container and the storage container are capable of sliding relative to the body, so that the storage container can slide with the dispensing container in the body when the dispensing container is being pulled out of the body. In the above description, the vertical section refers to a cross section of the dispensing container and the storage container taken along a direction perpendicular to the pulling direction of the dispensing container and the storage container. For example, if the dispensing container and the storage container are both pulled in the horizontal direction (that is, a direction parallel to the ground) of the traditional washing machine, then the plane in which the vertical section is located is the vertical plane (that is, a plane perpendicular to the ground); and if the dispensing container and the storage container are pulled in the vertical direction (that is, a direction perpendicular to the ground), then the vertical section is the horizontal plane (that is, a plane parallel to the ground). In a word, those skilled in the art can flexibly set the pulling direction of the dispensing container and the storage container, as long as the vertical section of the dispensing container is smaller than the vertical section of the storage container.

Preferably, the detergent dispensing assembly further includes a dispensing mechanism fixedly connected to or integrally formed with the body, and the dispensing container and the storage container are slidingly connected with the dispensing mechanism. The dispensing mechanism and the body are integrally formed to facilitate the molding and manufacturing of the die, and the dispensing mechanism and the body are fixedly connected to facilitate the installation and disassembly of components. The dispensing mechanism includes a containing cavity, the storage container is at least partially embedded in the containing cavity, and a length of the storage container is less than a length of the containing cavity. With this arrangement, the storage container can be accommodated in the containing cavity and move in the containing cavity, so as to realize the pulling operation of the drawer. The drawer of the present disclosure refers to a combined component formed after the dispensing container and the storage container are sealingly connected and installed.

Figure 2:
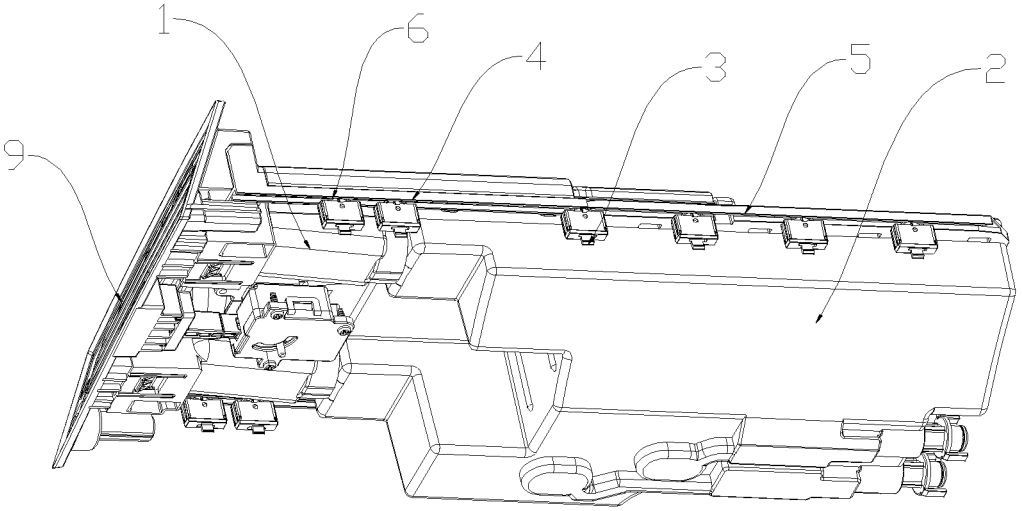
FIG. 2 is a second schematic structural view of a detergent dispensing assembly for use in a washing machine according to the present disclosure.
Figure 3:
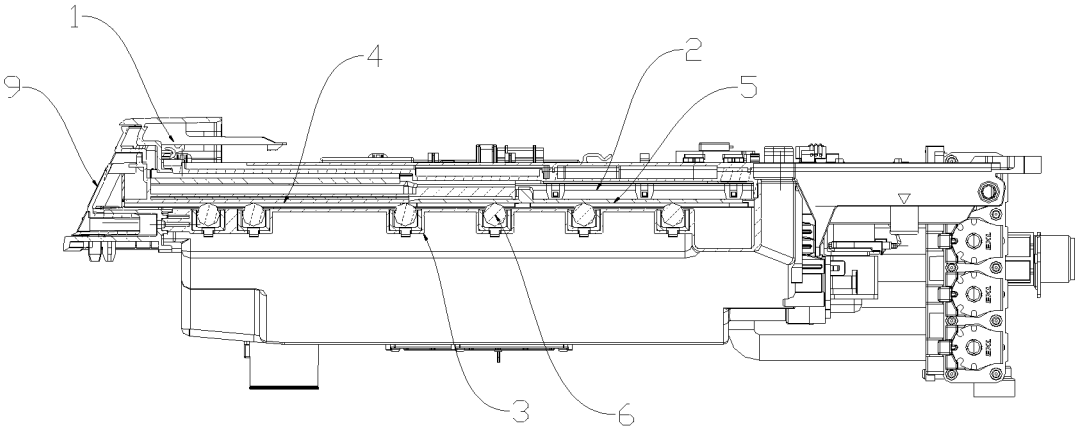
FIG. 3 is a schematic cross-sectional view of FIG. 1.

In a possible embodiment, a depth of the dispensing container 1 is smaller than a depth of the storage container 2. As shown in FIGS. 1 to 3, a top surface of the dispensing container 1 is substantially flush with a top surface of the storage container 2. A bottom surface of the dispensing container 1 is higher than a bottom surface of the storage container 2 in the vertical direction, so that the depth of the dispensing container 1 is smaller. In this case, since the dispensing container 1 is set relatively flat, a lateral elongated opening provided on the shell/panel of the washing machine can be adapted to the dispensing container 1, so that the control panel can also be set at a lower height, thereby making the overall appearance of the washing machine more beautiful.

In another possible embodiment, a width of the dispensing container 1 is smaller than a width of the storage container 2. In this case, the lateral size of the dispensing container 1 can be reduced, so that when the drawer is installed on the dispensing mechanism 3 of the body, more arrangement space can be reserved for other components such as the control panel, so that the size of the control panel can be designed larger, or the control panel and the detergent dispensing assembly can be designed more compact on the basis of meeting the design requirements, thereby improving the aesthetics of the overall appearance of the washing machine; it is even possible to integrate the control panel and the detergent dispensing assembly, thereby facilitating centralized maintenance and repair of the control panel and the detergent dispensing assembly.

Of course, the aforementioned two types of size design of the dispensing container 1 and the storage container 2 are only exemplary, the depth of the dispensing container 1 may also be set to be smaller than the depth of the storage container 2, and at the same time the width of the dispensing container 1 may also be set to be smaller than the width of the storage container 2, thereby further reducing the vertical sectional size of the dispensing container 1. Those skilled in the art can flexibly set the relative sizes of the dispensing container 1 and the storage container 2 in practical applications, as long as liquid transfer of the detergent between the dispensing container 1 and the storage container 2 and the dispensing operation of the detergent are not affected.

Preferably, as shown in FIGS. 1 to 3, the dispensing container 1 is provided with a first sliding portion 4, the storage container 2 is provided with a second sliding portion 5, and the dispensing mechanism 3 is provided with a plurality of rollers 6 matching the first sliding portion 4 and the second sliding portion 5; the dispensing container 1 is slidingly connected with the dispensing mechanism 3 through the first sliding portion 4 and the plurality of rollers 6, and the storage container 2 is slidingly connected with the dispensing mechanism 3 through the second sliding portion 5 and the plurality of rollers 6. The first sliding portion 4 may be a slideway, a slide rail and/or a slide groove and the like fixedly connected to or integrally formed with the dispensing container 1, as long as the matching of the first sliding portion 4 and the plurality of rollers 6 enables the dispensing container 1 to slide relative to the dispensing mechanism 3. Similarly, the second sliding portion 5 may also be a slideway, a slide rail and/or a slide groove and the like fixedly connected to or integrally formed with the storage container 2, as long as the matching of the second sliding portion 5 and the plurality of rollers 6 enables the storage container 2 to slide relative to the dispensing mechanism 3. Those skilled in the art may flexibly set the specific structures of the first sliding portion 4 and the second sliding portion 5 in practical applications. Such changes in the specific structures of the first sliding portion 4 and the second sliding portion 5 do not deviate from the technical solutions of the present disclosure. Moreover, in addition to the rolling mode, a pure sliding mode of double slide rail cooperation, slide rail and slide groove cooperation, or slide rail and slideway cooperation may be used for the sliding connection of the dispensing container 1 and the storage container 2 with the dispensing mechanism 3. The change of this sliding mode also does not deviate from the principle and scope of the present disclosure.

Further preferably, as shown in FIGS. 1 to 3, the first sliding portion 4 and the second sliding portion 5 are disposed collinearly. This arrangement facilitates the arrangement design of the plurality of rollers 6; that is, the plurality of rollers 6 may be directly disposed on the same straight line, and then the first sliding portion 4 and the second sliding portion 5 are each disposed to be collinear with the plurality of rollers 6 so that the pulling operation on the drawer is realized. This arrangement can reduce the difficulty in designing the product and facilitate consistent operations of the dispensing container 1 and the storage container 2.

Figure 4:
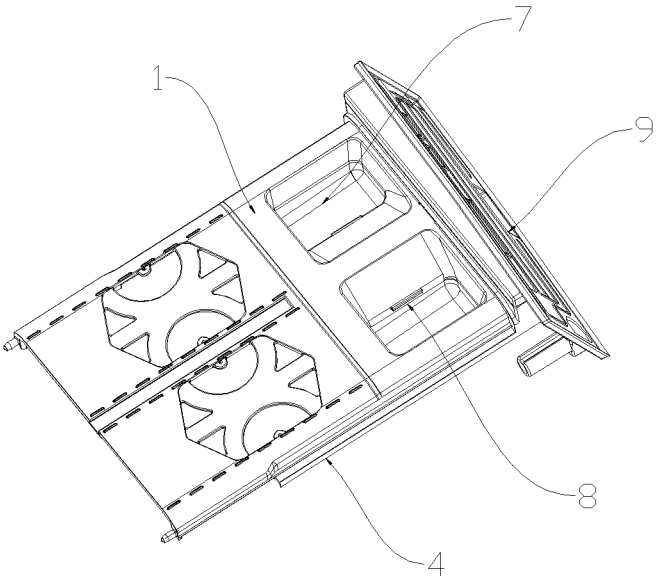
FIG. 4 is a schematic structural view of a dispensing container of a detergent dispensing assembly according to the present disclosure.

Preferably, as shown in FIG. 4, the dispensing container 1 is provided with a first dispensing cavity 7 and a second dispensing cavity 8, both of which are in communication with the storage container 2. The first dispensing cavity 7 is in communication with the storage container 2 through a first communication channel, the second dispensing cavity 8 is in communication with the storage container 2 through a second communication channel, and both the first communication channel and the second communication channel are disposed inclined downwardly in a direction toward the storage container 2 along the dispensing container 1. The first dispensing cavity 7 may be a detergent dispensing cavity, and the second dispensing cavity 8 may be a softener dispensing cavity. The operations of dispensing the detergent and the softener can be performed through the first dispensing cavity 7 and the second dispensing cavity 8. In addition, the first communication channel and the second communication channel may be constituted by a liquid outlet connector provided on the dispensing container 1 and a liquid inlet connector provided on the storage container 2, or may be constituted by a communication member (e.g., a sleeve group, etc.) disposed between the dispensing container 1 and the storage container 2. The specific structures of the first communication channel and the second communication channel may be flexibly set by those skilled in the art in practical applications, as long as the detergent in the first dispensing cavity 7 can be guided by the first communication channel into the storage container 2 and the softener in the second dispensing cavity 8 can be guided by the second communication channel into the storage container 2. Of course, the number of dispensing cavities on the dispensing container 1 is not limited to two, and may be other numbers. Those skilled in the art can flexibly set the number of dispensing cavities on the dispensing container 1 in practical applications, as long as different clothing treatment agents can be delivered to the storage container 2 by the dispensing cavities.

Preferably, as shown in FIGS. 1 to 4, the washing machine of the present disclosure further includes a trim panel 9 which is connected to the dispensing container 1, and when the detergent dispensing assembly is completely accommodated in the body, the trim panel 9 is flush with an outer surface of the washing machine. The trim panel 9 may be disposed on a front surface, an upper surface or a side surface of the washing machine. Those skilled in the art can flexibly set the specific position of the trim panel 9, and the trim panel 9 may be a panel only serving for decorative purpose, or may be a control panel integrated with a control module. Those skilled in the art can flexibly set the specific structure of the trim panel 9 in practical applications, as long as the trim panel 9 can cover the opening located on the shell/panel and adapted to the dispensing container 1 and can be kept flush with the outer surface of the washing machine when the drawer is completely accommodated in the body.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A clothing treatment agent dispensing assembly for use in a clothing treatment device, comprising a dispensing container, a storage container, and a dispensing mechanism that is configured to be fixedly connected to or integrally formed with the clothing treatment device, the dispensing container and the storage container being sealingly connected to each other and slidingly connected with the dispensing mechanism, wherein a vertical section of the dispensing container being smaller than a vertical section of the storage container;

wherein both the dispensing container and the storage container are configured to be capable of sliding relative to the clothing treatment device, so that the storage container can slide with the dispensing container in the clothing treatment device when the dispensing container is being pulled out of the clothing treatment device; and wherein the dispensing container is provided with a first sliding portion, the storage container is provided with a second sliding portion, and the dispensing mechanism is provided with a plurality of rollers matching the first sliding portion and the second sliding portion; the dispensing container is slidingly connected with the dispensing mechanism through the first sliding portion and the plurality of rollers, and the storage container is slidingly connected with the dispensing mechanism through the second sliding portion and the plurality of rollers.

2. The clothing treatment agent dispensing assembly according to claim 1, wherein the dispensing mechanism comprises a containing cavity, the storage container is at least partially embedded in the containing cavity, and a length of the storage container is less than a length of the containing cavity.

3. The clothing treatment agent dispensing assembly according to claim 1, wherein a depth of the dispensing container is smaller than a depth of the storage container, and/or a width of the dispensing container is smaller than a width of the storage container.

4. The clothing treatment agent dispensing assembly according to claim 1, wherein the first sliding portion and the second sliding portion are disposed collinearly.

5. The clothing treatment agent dispensing assembly according to claim 1, wherein the dispensing container is provided with a first dispensing cavity and a second dispensing cavity, both of which are in communication with the storage container.

6. The clothing treatment agent dispensing assembly according to claim 1, wherein the clothing treatment device further comprises a trim panel which is connected to the dispensing container, and when the clothing treatment agent dispensing assembly is completely accommodated in the clothing treatment device, the trim panel is flush with an outer surface of the clothing treatment device.

7. A clothing treatment device, comprising the clothing treatment agent dispensing assembly according to claim 1.

* * * * *